United States Patent [19]

Obinata et al.

[11] 4,143,211

[45] Mar. 6, 1979

[54] CONTINUOUS CASTING ADDITION MATERIAL

[75] Inventors: Tatsuichi Obinata, Tokyo; Kaname Wada, Kisarazu; Shigeaki Ogibayashi; Hironobu Mihara, both of Kimitsu, all of Japan

[73] Assignees: Nippon Steel Corporation; Hitachi Cable Ltd., both of Tokyo, Japan

[21] Appl. No.: 806,961

[22] Filed: Jun. 15, 1977

Related U.S. Application Data

[62] Division of Ser. No. 571,973, Apr. 28, 1975, Pat. No. 4,047,556.

[30] Foreign Application Priority Data

May 1, 1974 [JP] Japan ..... 49-48324

[51] Int. Cl.[2] ..... C21C 7/00

[52] U.S. Cl. ..... 428/650; 75/53; 75/58

[58] Field of Search ..... 75/53, 129, 135, 58; 428/650; 148/26

[56] References Cited

U.S. PATENT DOCUMENTS

| | | | |
|---|---|---|---|
| 3,175,074 | 3/1965 | Culbertson | 148/26 |
| 3,634,075 | 1/1972 | Hoff | 75/53 |
| 3,729,309 | 4/1973 | Kawawa | 75/53 |
| 3,738,827 | 6/1973 | Pryor | 75/53 |
| 3,768,999 | 10/1973 | Ohkubo | 75/53 |

*Primary Examiner*—P. D. Rosenberg

*Attorney, Agent, or Firm*—Toren, McGeady and Stanger

[57] ABSTRACT

A method for producing steels by continuous casting, in which an addition material composed of an addition metal or alloy in the form of wire and a cover metal covering the addition metal or alloy is dissolved at a predetermined depth of the molten steel in a mold for continuous casting, and the cover metal prevents the addition metal from dissolving at undesired position in the molten steel, thus very advantageous for production of high grade steels and cored steels.

3 Claims, 7 Drawing Figures

FIG.2
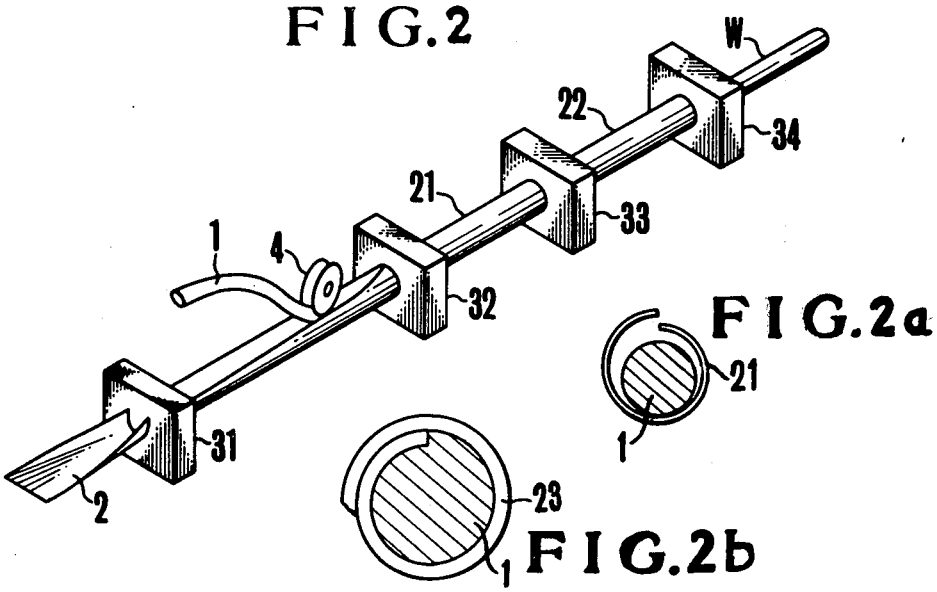
FIG.2a
FIG.2b
FIG.1
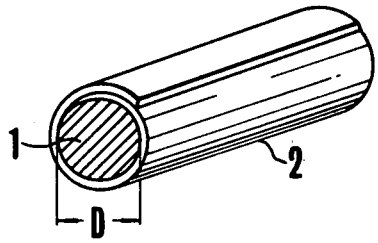

CONTINUOUS CASTING ADDITION MATERIAL

This is a Division of application Ser. No. 571,973, filed on Apr. 28, 1975, now U.S. Pat. No. 4,047,556.

The present invention relates to a method for continuous casting of steel with addition of special elements and relates to the addition material.

While high grade steels are produced presently by an ordinary ingot making method in many cases, such high grade steels are usually a killed steel, and has such shortcomings as low break-down yield and high production cost. Therefore, if a continuous casting method which gives advantages as a high production yield and low production cost can be applied to the production of such high grade steels, its contribution would be very remarkable.

However, generally speaking, in case of high grade steels, it is often necessary to add special elements with strong reactivity in such a manner that contents of the elements fall in a narrow range. The special elements mentioned here include Al, Mo, Ca, Ti, Zr, B, rare earth elements (hereinafter called REM), V, Nb, etc., and requirements for adding such elements are diversified. For example, addition of Al is needed for enhancing drawability of thin steel plates as well as general composition adjustment and deoxidation, and Ca is used for deoxidation and cleaning of the steel or as a form controlling agent for sulfides, and Ti, Zr as for form control of sulfides and for enhancing workability of high strength steel plates and securing strength of the same, Ti is also for non-ageing of cold rolled steel sheets by its fixation of carbon and nitrogen and for deep-drawability, and B is for enhancing hardening property and securing strength, REM is for form controlling of sulfides, enhancing workability of steel plates, enhancing resistance against lamellar tear, enhancing resistance against cracking induced by hydrogen, enhancing enamelling property, or further enhancing impact value, and V, Nb are for maintaining required toughness.

Heretofore, addition of these special elements is made generally to a ladle at the time of tapping, or to a tandish in continuous casting. Problems encountered by the conventional art are:

(i) There is great yield loss of the additives at the time of addition or till casting.

(ii) As the yield greatly varies, it is difficult to make addition in a narrow range.

(iii) While addition can be made uniformly into molten steel, depending on the kinds and quantity of the elements added, there will be surface defects on the cast slabs because of the uniformly of addition itself.

That is, among the special elements illustrated above, Al, Ca, Ti, Zn, REM, have strong affinity with oxygen as known well, and the yield loss mentioned above in (i) is great because of oxidation by air, reaction with slug, reaction with refractories, and reaction with powder in the case of a powder casting method for continuous casting, etc. There are also such secondary problems that reaction products (oxides) formed by the above reactions adhere to the inside wall of the tandish nozzle at the time of continuous casting, causing clogging of the nozzle.

Next, the special elements illustrated above, B, REM, Nb exist uniformly in the molten steel, as mentioned in the above problem (iii), naturally they exist in the surfacial layer of the slab or ingot, and according to the result of studies by the present inventors such defect as surface cracking is caused because of their presence depending on their kinds and quantities. That is, the continuously cast steel slab receives thermal stress and mechanical stress at the time of casting, and thus surface cracking is more apt to be caused as compared with the steel ingot, and the cracking sharply increases when REM elements are added because of their presence in the surface of the cast slab. Thus the above mentioned problems accompany with the ladle addition or tandish addition.

Contrary to this, a method has been proposed according to which addition metals in a wire form are directly added to molten steel contained in a casting mold in the continuous casting process. Since addition is made without passage through a nozzle in this method, the nozzle clogging due to the above mentioned problems is solved and the yield loss is also somewhat reduced, but according to the studies made by the present inventors, saving of the yield loss due to the reaction with powder within the casting mold is quite imperfect, and control of the addition amount in a narrow range is not satisfactory with poor operation efficiency, thus stable addition can not be assured at all. Further, this method does not contribute for solving the problems of defects in the cast slab mentioned in (iii) above.

Therefore, there have been following problems left unsolved in case of the addition of the special elements mentioned above to the molten steel being continuously cast:

(a) to make addition with high yield and satisfactory control of the addition amount, (b) addition is made without causing defects such as cracks in the cast slab, (c) addition is made with high operation efficiency in a stable manner.

An object of the present invention is to provide a low cost production method of steel by continuous casting in which the above problems (a) to (c) are eliminated, allowing stable addition of special elements into molten steel, thereby securing effect of the special elements. The present invention is particularly advantageous for production of continuously cast slabs for high-toughness thick steel plates for pipe lines and deep-drawing cold rolled steel sheet and enamelgrade steel plates as well as for production of cored steels. The basic technical thought of the present invention lies in adding metal or alloy in the form of a wire to the molten steel with adjustment of the casting speed and the addition amount, namely the wire diameter and the wire supplying speed so as to assure a desired amount of addition, and in covering or wrapping the wire-formed addition metal or alloy with a covering material, which dissolves away at a predetermined depth in the molten steel depending on the above adjusted wire supplying speed so that the addition metal or alloy does not contact with the powder layer on the surface of the molten steel and is exposed to the molten steel only at a desired depth in the molten steel.

The present invention will be further explained in detail in reference to the attached drawings.

FIG. 1 shows an example of the addition material in wire form according to the present invention.

FIG. 2 shows a schematic view of production process of the addition material shown in FIG. 1.

Figure 3:
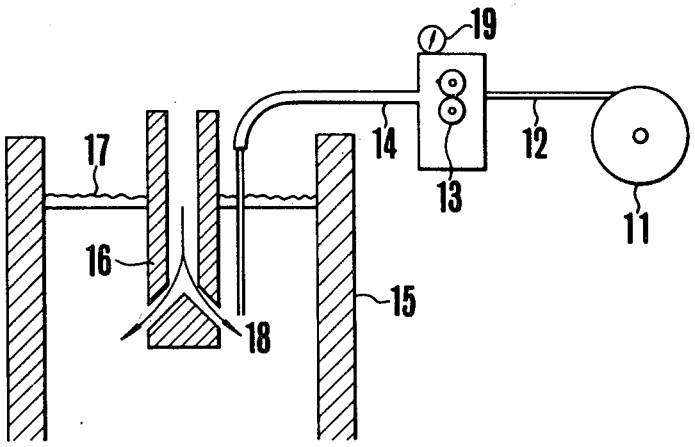
FIG. 3 shows a schematic view of addition of the addition material into the molten steel in a mold.

One of the most important fueature of the present invention lies in that for assuring the addition of metal or alloy with satisfactory operation efficiency in a stable manner and with high yield by preventing the reaction with the powder covering the surface of molten steel and the oxidation by air near the surface, a metal-covered addition material obtained by so covering an addition metal 1 in the form of wire with a covering metal 2 with weak reactivity in a thin sheet shape of predetermined thickness around the wire metal 1 in such a manner that its side portions are over-lapped with each other in a lengthwise direction as shown in FIG. 2 is supplied to the molten steel in a mold. The reason for employing such covering method is not only that the production cost is low, but also that a long coil can be made easily and that the uniform thickness of the covering metal which has important significance as will be explained below can be easily chosen as compared with the method comprising pouring the above mentioned addition metal in molten state into a metal tube then rolling or drawing the same. In this case, the overlapped portion covers preferably 45° or more as viewed from the center point of the wire.

Another feature of the present invention lies in that by so determining the thickness of the above mentioned covering metal material that the covering metal is dissolved away at a desired depth of the molten steel, the addition metal is made to contact with and melt in the molten steel at the desired depth, so that the addition metal can be uniformly added to the molten steel along with the feeding flow out of the nozzle immersed in the molten steel, and at the same time, if necessary such addition elements having large tendency of causing cracks is made to melt at a deeper position from the surface of molten steel, so as to assure that these elements are added only to the core of cast slabs, thus the most suitable condition for dissolving the addition metal can be selected according to the kinds and addition amounts of the addition metals. According to the results of studies made by the present inventors, in order to have the addition metal added uniformly into the molten steel along the feeding stream from the nozzle without reacting with the powder covering the surface of molten steel as they are added, the melting position of the addition materials need to be 20 mm below the surface of molten steel or deeper, preferably 50 mm or deeper, and in this case, the thickness of the metal covering the addition metal must be determined so as to assure the desired melting depth H ($H \geqq 20$ mm).

The depth can be determined from the following formula;

$$d = 0.5D\left(1 - \sqrt{1 - \frac{4H}{DAv}}\right) \quad (1)$$

wherein;

d: Thickness of the covering metal,

D: Diameter of the addition metal wire, v: Linear speed of the wire supply,

A: Constant which varies depending on the kind of the covering metal, condition of the covering, the kind of addition metal, and the temperature of molten steel, and H: Desired depth of melting position of the addition material.

Also the linear speed of wire supply appearing in the formula (1) is determined by the following formula from the desired contents of addition elements in the steel:

$$-V = \alpha MC/D^2 \quad (2)$$

wherein;

M: Casting speed (Ton/min.),

C: Desired contents of addition elements in the steel,

D: Diameter of the addition metal wire, and $\alpha$: a constant which varies depending on the weight of addition elements contained in unit volume of the addition material and addition yield.

As has been explained, when Nb, REM, B, etc. are added defects as surface crackings, etc. are caused, if these elements are present near the surface of molten steel even when the depth of melting position H is 20 mm or deeper. However, according to the studies made by the present inventors, the elements are dissolved by a downward feed stream from the immersed nozzle by setting the depth of dissolving position at $$H \geqq 100 \text{ mm} \quad (3)$$

or preferably at $$H \geqq 150 \text{ mm}$$

therefore, the elements will not exist near the surface of the cast slab, instead uniformly exist only in the core portion of the cast slab, thus addition can be easily made without generating the above mentioned defects. In this way, it is possible to produce a cored steel satisfactory. In order to obtain a desired depth of dissolving position within the range shown by the formula (3), for example, a metal covered addition material consisting of a covering metal of a thickness determined by the formula (1) may be used. At this time, since the diameter of the wire and the feeding linear speed are not independent each other, instead they are inter-related by the formula (2). Therefore, the thickness of the covering metal needs to be "consolidatedly" determined to a desired value in view of the operation efficiency and the wire production along with the diameter of the wire and the feeding linear speed based on the desired addition amount and the depth of dissolving position.

Also if the diameter D of the addition metal wire is too small, it not only causes production difficulties but it requires a very fast feeding linear speed as understood from the fomula (2). This is not practical from standpoints of the operation efficiency and the feeding equipment. Contrary to this, when the diameter is too large, flexibility necessary for facilitating the feeding operation becomes insufficient, and therefore it is desired to be within the following range:

$$1 \text{ mm} \leqq D \leqq 10 \text{ mm}$$

(wherein D: diameter of addition metal wire).

Further, when the addition material in wire form is fed, it is very often difficult to add the addition material perpendicular to the surface of molten steel because of the positional relationship with the tandish, thus it needs to be added obliquely, and if the angle formed by the addition material is too small, not only the material dissolving position becomes shallow, but there will be such a risk that unsolved portion of the wire hits the nozzle immersed below the molten steel surface. Therefore, it is desired that the angle is within the following range:

$$20° \leqq \theta \leqq 90°$$

While there are many cases wherein when the wire shape addition material having a covering metal of such thickness as determined by the formula (1) is added to the molten steel, the feeding linear speed needs to be changed depending on the casting condition, even in such case casting may be made by controlling the dissolving depth by the following formula which is made by solving the formula (1) reversely:

$$H = A \cdot d \cdot [1 - (d/D] v \quad (4)$$

The weak reactivity metal as used for the covering metal 2 in FIG. 1 in the present invention means a metal with lower reactivity as compared with that of the above mentioned addition metals, and Fe is most commonly known while Cu, Al, Ni, Mo etc. may also be used depending on the purposes.

Furthermore, when it is necessary to prevent not only the reaction with the powder but to completely prevent the taking in of the powder at the time of addition, a refractory ring etc. is provided between the powder layer and the surface of molten steel and the addition material is made to pass through the same for making the addition without direct contact between the addition material and the powder.

The powder mentioned herein is to be added to the surface of molten steel in continuous casting for the purpose of lubrication between the cast slab and the wall surface of the mold and for prevention of oxidation of the surface of molten steel, and has the following composition for example: C $\leqq$ 11%, $SiO_2$: 30 to 45%, $Al_2O_3$ : 2 to 16%, CaO : 25 to 45%, $Fe_2O_3 \leqq$ 6%, Na $\leqq$ 11%, F $\leqq$ 9%.

The addition metal in the present invention means a wire shape metal consisting of simple substance or alloy substance of desired addition elements, wherein the state of covering the addition metal with a covering metal must be clearly distinguished from the state of covering addition metal in granular shape with a covering metal. The effect of such structure lies in that undue generation of gas during the supply of the addition metal into molten steel can be completely eliminated. Such a metal covered addition material may be made by covering or wrapping the addition element in wire form with a metal covering addition material.

Next, explanations will be made on the method of producing the addition material in wire form used in the present invention. In FIG. 2, 1 is a thin metal tape forming an outer layer, for example, a steel tape, and this tape is taken out of a reel with larger with than the exterior circumferential length of the addition material 2 and is sent through a first die 31 to a second die 32.

The first die 31 has a hole of U-shape being larger than the width of the tape, and the second die 32 has a circumferential length larger than the width of the tape and has a hole of such shape as being able to form the tape 2 as shown in FIG. 2-*a*. Therefore, the tape 2 is bent to U-shape in lateral direction by having it pass through the dies 31, 32, so that it can cover the addition metal 1 in wire form made of for example, aluminum, mesh metal, titanium magnesium, calcium, etc. in wire shape. 4 is a guide for guiding the addition metal into a formed tube-shape tape 21.

The tubular tape 21 which covers the addition wire metal 1 after the second die 32 is consecutively sent through a third die 33 to a fourth die 34. The third die 33 has a hole with a circumferential length being smaller than the width of the tape, while the fourth die 34 has a hole with a diameter being somewhat larger than the outer diameter of the addition wire metal 1. Therefore, the tubular tape 21 becomes a fine tube 22 with its both side portions overlapped when it goes through the third die 33, and then is compressed as it passes through the fourth die 34 with its overlapping of both side portions increased and forming an outer cover 23 being closely adhering to the addition metal 2 as shown in FIG. 2-*b*, then is taken up by a coiler either going through a fifth die or without going through the same.

The compound wire material W thus obtained will be completely shielded from outside as the main body 1 is covered by overlapping of the tape constituting the outer cover 23.

Therefore, even if the main body 1 is of moisture absorbent deforming nature and is of thermally or mechanically inferior as compared with the outer cover 23, it can be stored or used without special care. In this way, it is possible to add uniformly the addition elements with a high yield in a stable manner by using the wire formed covered addition material according to the present invention.

As has been explained according to the present explanation not only additive elements can be added uniformly with high yield and in stable manner, but by determining an optimum wire diameter and thickness of the covering metal according to the above mentioned various kinds of steel and addition elements to which the present inention is directed and amount of addition, the optimum dissolving condition can be easily realized, and therefore addition can be made without generating such defects as cracks in cast slabs, etc. Thus various kinds of high grade steels as mentioned hereinbefore, may be easily produced. Rolling, heating, thermal process, etc. of the slabs obtained according to the present invention may be done by a conventional method.

The present invention will be more clearly understood from the following examples.

EXAMPLE 1

Now an example will described for production of a steel X52 (API standard) with high toughness for line pipe using rare earth metals as an addition element.

Molten steel prepared in a converter and having a composition adjusted by deoxidation of C: 0.15%, Si: 0.24%, Mn: 1.37%, P: 0.023%, S: 0.009%, Nb: 0.04% is poured through an immersed nozzle into a casting mold of width 1880 mm and thickness 210 mm in a continuous casting process with a casting speed of 2.16 Ton/min. At this time, rare earth metal in wire form of diameter 4.3 mm consisting of Ce: 48%, La: 30%, Nd: 15%, Pr: 4% is added aiming to a content of 0.022% rare earth metal according to the present invention for changing Mn sulfide which is easy to be elongated into a rare earth metal sulfide which is hard to be elongated. That is, according to the formula (2), the value of $\alpha$ in the case of the rare earth metal, 0.00193 is used and the equation is solved as $v = 0.00193 \times 2.16 \times 0.022 / (4.3 \times 10^{-3})^2 = 5.0$ (m/min.), and further, and using the desired dissolving depth of 150 mm and the value 87

(min./m) of A in the case of iron cover the thickness d of the iron cover is obtained as $$d = 0.5 \times 4.3 \{1 - \sqrt{1 - \frac{4 \times 150}{4.3 \times 87 \times 5.0}}\} = 0.38.$$

Therefore, the above mentioned wire form rare earth metal of a diameter 4.3 mm is covered with a thin steel sheet of 0.38 mm thickness to make an iron covered rare earth metal beforehand, which is fed into molten steel in the casting mold with feeding linear speed of 5.0 m/min. using a device shown in FIG. 3. That is, the above mentioned 12 being wound on a drum 11 was fed through a guide 14 into molten steel 18 in a casting mold 15 continuously by a feeding roller 13 with its feeding linear speed controlled by a speed meter 19. Molten steel is poured into a mold 15 through an immersed nozzle 16. At this time, as the rare earth metal is protected by a covering thin steel sheet 2 in FIG. 1, it will not react with powder 17. The slab thus obtained is rolled heating them to 1250° C. to obtain a thick plate with 60 mm thickness, then it is further rolled at 900° C. to 730° C. to obtain a thick plate of 12.7 mm thickness. The mechanical properties as rolled of the thick plate thus obtained will be shown as steel material 1 in Table 1.

Properties of another thick plate made by continuously adding a rare earth metal wire of 10ϕ × 30 mm into another charge of molten metal having almost same composition as that of the above mentioned slab through a tandish during casting, are also shown in Table 1 as comparative material 2. As seen from Table 1, the percentage of rare earth metal in steel material 1 of the present invention is 0.022% just as intended, as a result the absorbed energy at −20° C. is enhanced by 19 ft-lb as compared with the comparative material 2, and not only the transition temperature becomes more than 3° C. lower but the rare earth metal yield increased twice or more, and properties in general are improved very efficiently. Also as shown by the comparative material 1, when a steel covered rare earth metal wire obtained by covering the rare earth metal in wire form of 4.3 mm diameter with a thin steel sheet of 0.15 mm thickness is added to the molten steel of same charge as that of the material of present invention but in a different strand with a feeding linear speed of 5.0 m/min., vertical cracks are cuased on the surface of the slab due to the fact that the depth of molten steel is too shallow, thus final product can not be obtained.

Next, explanations will be made on Steel Material 2 of the present invention which is obtained by adding a rare earth metal to a super-low sulfur steel containing 0.003% S, and which is used as a high-grade steel for pipe line material comparing to X 65 steel of API standard.

Molten steel having a ladle composition of C = 0.12%, Si = 0.25%, Mn = 1.27%, P = 0.014%, S = 0.003%, total Al = 0.022%, Nb = 0.04% and V = 0.02% was cast into steel slabs of 2050 mm width and 210 mm thickness was cast by continuous casting and the slabs were drawn with a speed of 0.65 m/min. During this stage, a wire-form rare earth metal of 3.6 mm diameter was added to the molten steel at a line speed of 4.2 m/min. in the same way as in case of Steel Material 1 of the present invention and the same rolling procedure was applied. As shown in the table, the operation efficiency of the continuous casting is stable and the surface condition of the slabs is satisfactory also in case of Steel Material 2.

Further, the absorbed energy at −20° C. is 97 ft-lb which indicates very excellent impact property. Thus, the present invention is very advantageous for production of a high-grade line-pipe steel material.

Table 1

| | Examples of Line-Pipe Steel Materials | | | | | | | | |
|---|---|---|---|---|---|---|---|---|---|
| | Steel Material of Present Invention 1 | | | | Steel Material of Present Invention 2 | | | | |
| Steel Making Furnace | 250 ton converter | | | | same as left | | | | |
| Composition of Molten Steel (%) | C | Si | Mn | P | C | Si | Mn | P | |
| | 0.15 | 0.24 | 1.37 | 0.013 | 0.12 | 0.25 | 1.27 | 0.014 | |
| | S | Al | Nb | S | Al | Nb | V | | |
| | 0.009 | 0.025 | 0.04 | | 0.003 | 0.022 | 0.04 | 0.02 | |
| Strand | No. 1 Strand | | | | No. 1 Strand | | | | |
| Slab Drawing Speed | 0.7 m/min. | | | | 0.65 m/min. | | | | |
| Addition Composition (%) | Ce | La | Nd | Pr | same as left | | | | |
| | 48 | 30 | 15 | 4 | | | | | |
| Addition Shape Diameter | 4.3 mmϕ | | | | 3.6 mmϕ | | | | |
| Addition Shape Covering | Wire | | | | Wire | | | | |
| Addition Metal Covering | Thin steel sheet of 0.38 mm thickness | | | | Thin steel sheet of 0.45 mm thickness | | | | |
| Addition Feeding and Linear Speed | 5.0 m/min. | | | | 4.2 m/min. | | | | |
| Addition of Feeding Speed | 493 g/min. | | | | 289 g/min. | | | | |
| Addition Feeding Others Angle | 60° | | | | 60° | | | | |
| Addition Position | to molten metal in a mold | | | | same as left | | | | |
| Addition Method | Continuously fed by a device shown in Fig. 3 | | | | same as left | | | | |
| Addition Metal Yield | 98% | | | | 97% | | | | |
| Slab Composition (%) | C | Si | Mn | P | C | Si | Mn | P | |
| | 0.15 | 0.25 | 1.36 | 0.015 | 0.12 | 0.25 | 1.25 | 0.015 | |
| | S | Al | Nb | REM | S | Al | Nb | V | REM |
| | 0.009 | 0.023 | 0.04 | 0.02 | 0.003 | 0.021 | 0.04 | 0.02 | 0.013 |
| Surface Condition of Slabs | Good | | | | Good | | | | |

| | | Comparative Material 1 | | | | Comparative Material 2 | | | |
|---|---|---|---|---|---|---|---|---|---|
| | | Examples of Line-Pipe Steel Materials | | | | | | | |
| Steel Making Furnace | | 250 ton Converter | | | | same as left | | | |
| Composition of Molten Steel(%) | | C | Si | Mn | P | C | Si | Mn | P |
| | | 0.15 | 0.24 | 1.37 | 0.013 | 0.14 | 0.25 | 1.35 | 0.013 |
| | | S | Nb | | | S | Nb | | |
| | | 0.009 | 0.04 | | | 0.009 | 0.04 | | |
| Strand | | No. 2 Strand | | | | No. 1 Strand | | | |
| Slab Drawing Speed | | 0.7 m/min. | | | | 0.7 m/min. | | | |
| Addition of | Composition (%) | Ce | La | Nd | Pr | | | | |
| | | 48 | 30 | 15 | 4 | | | | |
| | Shape | | | | | same as left | | | |
| | Diameter : | 4.3 mmϕ | | | | 10 mmϕ | | | |
| | Shape : | Wire | | | | Length 30 mm | | | |
| | Covering and Metal : | Thin steel sheet of 0.15 mm thickness | | | | Metal Tube : None | | | |
| | Feeding | | | | | | | | |
| | Linear Speed: | 5.0 m/min. | | | | | | | |
| | Feeding Speed: | 493 g/min. | | | | Feeding Speed: 31 pieces/min. (496 g/min.) | | | |
| | Feeding Angle : | 60° | | | | | | | |
| | Others Addition Position: | Molten Metal in a Mold | | | | Molten Steel in a Tandish | | | |
| | Addition Method : | Continuously fed by a device shown in FIG. 3 | | | | Continuously fed in | | | |
| | Addition Yield : | 95% | | | | 40% | | | |
| Metal Slab Composition (%) | | C | Si | Mn | P | C | Si | Mn | P |
| | | 0.16 | 0.26 | 1.38 | 0.015 | 0.14 | 0.27 | 1.37 | 0.014 |
| | | S | Nb | REM | Al | S | Nb | REM | Al |
| | | 0.009 | 0.04 | 0.021 | 0.023 | 0.009 | 0.04 | 0.009 | 0.023 |
| Surface Condition of Slabs | | Longitudinal cracking occurred on the slab surface (Rank E)* | | | | Longitudinal cracking occurred on the slab surface (Rank c)* | | | |

*The surface condition is classified into 6 classes by the number and size of the crackings, ranging from O, A - E, E being the worst.

| | | Steel Material of Present Invention 1 | Steel Material of Present Invention 2 | Comparative Material 1 | Comparative Material 2 |
|---|---|---|---|---|---|
| Cross-Sectional Size of Slab | | 210mm × 1880mm | 210mm × 2050mm | 210mm × 1880mm | 210mm × 1880mm |
| Thick | Slab Heating Temp. | 1250° C | 1250° C | Large amount of REM is contained near skin of cast piece. Because of large vertical cracks generated on slab surface final product could not be obtained. | 1250° C |
| | Finishing Rolling Temperature | 730° C | 740° C | | 730° C |
| Plate | Final Plate Thickness | 12.7 mm | 10.5 mm | | 12.7 mm |
| Process Operating Efficiency when Rare Earth Metal was added. | | No nozzle clogging. No smoke generated with satisfactory working condition. | Same as left | Same as left | Because of nozzle clogging, the nozzle was cleaned by $O_2$ gas. Smoke generated. |
| Properties in a Direction Perpendicular to Rolling Direction | Full Size vE −20° C (ft-lb) | 59 | 97 | | 40 |
| | Transition Temperature (° C) | <−80 | <−80 | | −77 |
| | Yield Strength ($10^3$ psi) | 69 | 76 | | 70 |
| | Elongation (%) | 35 | 36 | | 33 |
| | Tensile Strength $10^3$ psi) | 82 | 87 | | 83 |

Following Examples 2 and 3 show production of a cored steel according to the present invention for an enamel grade steel sheet and a deep-drawing steel sheet respectively.

EXAMPLE 2

Molten steel made in a 250-ton convertor having C: 0.023%, Si: 0.01%, Mn: 0.17%, P: 0.010%, S: 0.008% by adding Fe-Mn at the time of tapping was subjected to vacuum degassing treatment and Al was added for deoxidation then Ti was added. The composition after the vacuum degassing treatment was C: 0.008%, Si: 0.01%, Mn: 0.17%, P: 0.011%, S: 0.008%, Ti: 0.043%. Molten steel thus obtained was subjected to continuous casting into a mold with cross section of 210 × 1480 $mm^2$ by a curved-type continuous casting machine with 2 strands. At this time, a steel-covered rare earth metal wire made beforehand by covering a rare earth metal wire of 4.0 mm diameter with a thin steel sheet of 0.31 mm thickness is supplied to molten steel in the mold at a linear feeding speed of 10.0 m/min. As the rare earth metal, a Misch metal was used. The thickness of the thin steel sheet was determined by the formula (1), so as to assure that the depth of dissolving position of the Misch metal will be 250 mm deep from the surface of the molten steel. That is, using the value 87 (min./m) of A obtained from experiments for the Misch metal it is determined as follows:

$$\left(1 - \sqrt{1 - \frac{4 \times 250}{4.0 \times 87 \times 10.0}}\right) = 0.31 \text{ mm}$$

Figure 4:
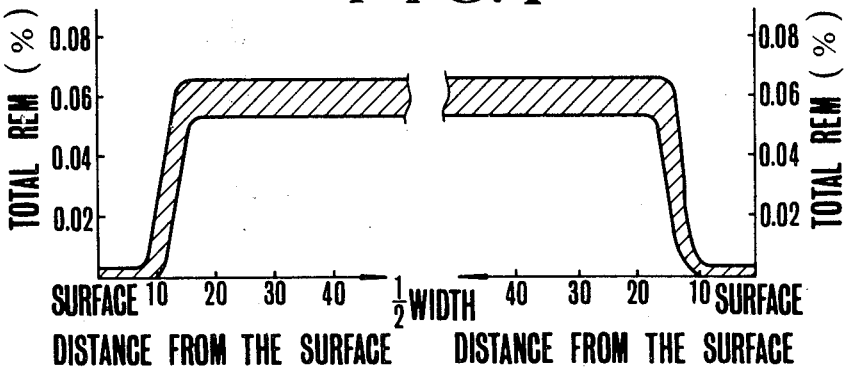
FIG. 4 is a graphical representation of the rare earth metal distribution relative to the distance from the surface of the molten bath.

After casting of about 25 m, the latter half was made in No. 2 strand with a Misch metal wire of 4.0 mm diameter without covering being supplied thereto, while in No. 1 strand a steel-covered Misch metal wire made by covering a Misch metal wire of 4.0 mm diameter with a thin steel sheet of 0.1 mm thickness just considering flexibility only supplied thereto, at a linear feeding speed of 10.0 m/min. Supply of the wire was made in both cases using a device shown in FIG. 3 with a controlled linear feeding speed. The drawing speed of cast slab was 0.7 m/min. Thus 5 slabs of about 10 m length were obtained for one strand, then 2 cross-section samples were taken from each of the slabs of the first half and the latter half casting to analyze the cross-sectional distribution of the rear earth metals at ¼ thickness and ¾ thickness positions with 2 mm intervals in the surface layer and 10 mm intervals in the core portion in the slabs width direction. Also surface defects of the slabs were observed. The results thereof are shown in Table 2 and FIG. 4. As shown the same level of the rare earth metal content was shown in the slab surface layer as that in the core portion in the comparative materials, I, J, and the longitudinal surface crackings were caused at a ½ slab width position, while in the material of the present invention, no rare earth metal was contained in the core portion within 15 mm from the skin, but the intended rare earth metal content of about 0.06% was contained in the core portion within 15 mm from the skin, yet no surface crackings were observed with giving a satisfactory surface condition. No reaction with the powder was observed during the addition operation and the yield was also satisfactory.

The thickness of the thin steel sheet was determined from the formula (1) which was so obtained beforehand that the depth of the dissolving position of titanium will be 250 mm deep from the surface of molten steel.

For comparison purpose, 0.8 kg/T of titanium was added to molten steel which is substantially same as the steel K of the present invention within DH tank and casting was done under the same condition as in case of steel K. Of course no titanium addition was done to the mold at the time of continuous casting in this case.

When the slab of the present invention thus obtained and the comparative slab were hot rolled, surfaces thereof were removed only 2.5 mm from the surface and were subjected to the hot rolling.

Figure 5:
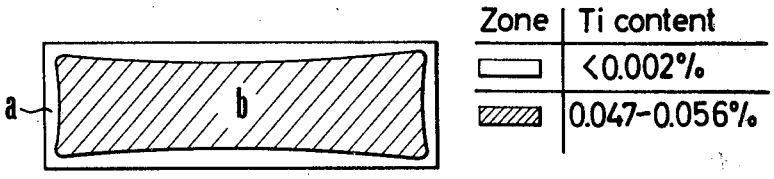
FIG. 5 is a cross-sectional representation of the titanium content of the solidifying mold.

For reference purpose, cross-sectional samples were obtained from the slab obtained by the present invention and cross-sectional distribution of titanium was analyzed, and it was revealed that in the steel of the present invention in which the thickness of the cover was determined so that titanium was made to contact with and the molten steel at the depth of 250 mm from the surface of molten steel, titanium content in the surface layer a within average of 8 mm from the skin is almost nil while it was uniformly contained in the core portion 6 as shown in FIG. 5, thus forming a core addition steel.

The steel of the present invention and the comparative steel were hot rolled and were coiled at a hot coiling temperature of 590° C. with a sheet thickness of 5.0 mm. and then were cold rolled down to a sheet thickness of 1.2 mm and were box annealed at 700° C. for 12 hours and skin pass rolling of 1% was done.

Table 2

| | | Strand | Stage of Casting | Addition Material | Number of Slab | Total Rare Earth Metal (%) Surface | Total Rare Earth Metal (%) Core | Yield of Rare Earth Metal | Slab Surface Condition |
|---|---|---|---|---|---|---|---|---|---|
| Steel of Present Invention | G | No.1 | first half | Misch metal wire of 4mm diameter covered by steel sheet of 0.25mm thickness | 2 | <0.002 | 0.054 ∫ 0.065 | 98% | Good |
| " | H | No.2 | " | " | 2 | <0.002 | 0.055 ∫ 0.066 | 98% | " |
| Comparative Steel | I | No.1 | latter half | Misch metal wire of 4mm diameter covered by steel sheet of 0.1mm thickness | 2 | 0.056 ∫ 0.068 | 0.053 0.064 | 95% | Longitudial crackings |
| " | J | No.2 | " | Misch metal wire with no covering | 2 | 0.031 ∫ 0.043 | 0.026 ∫ 0.042 | 57% | " |

Remark: In Steel J, the addition was made after the powder near the wire addition position and been removed, and yet reaction with the powder was observed.

EXAMPLE 3

Molten steel made by a converter having a ladle composition of 0.019% C and 0.17% Mn was subjected to vacuum degassing treatment to lower the carbon content to 0.006% and then deoxidized with aluminum. The thus obtained molten steel was cast into a mold of 210 × 1480 mm cross-section and continuously cast by a curved-type continuous casting machine with two strands at a drawing speed of 0.7 m/min.

For Ti addition, as steel-covered titanium wire made by covering a titanium wire of 4.5 diameter with a thin steel sheet of 0.1 mm thickness was supplied to the molten steel in the mold at a feeding linear speed of 12.7 m/min.

The production results of the steel of the present invention and the comparative steel and their chemical analysises are shown in Table 3 while mechanical test values and data of the surface conditions are shown in Table 4.

As seen in Table 4, the steel of the present invention has a higher titanium yield as compared with that obtained in the conventional method, and has an excellent deep drawing property yet shows satisfactory surface conditions.

Table 3

| Production Conditions and Chemical Analysis of Products | | |
|---|---|---|
| Addition of Steel-Covered Titanium Wire in Mold | Addition in | Chemical Analysis of Products (%) |

Table 3-continued

| | Production Conditions and Chemical Analysis of Products | | | | | | | | |
|---|---|---|---|---|---|---|---|---|---|
| | D | d | v | DH Tank | C | Si | Mn | P | S |
| Steel K of Present Invention | 4.5 | 0.1 | 12.7 | — | 0.004 | 0.01 | 0.17 | 0.013 | 0.008 |
| Comparative Steel L | — | — | — | 0.8kg/T | 0.004 | 0.01 | 0.16 | 0.011 | 0.007 |

| | Chemical Analysis of Products (%) | | | Ti Contens in Slab (%) | | |
|---|---|---|---|---|---|---|
| | Total Ti | O | N | Surface Layer | Core Portion | Slab Surface Condition |
| Steel K | 0.050 | 0.0053 | 0.0057 | <0.002 | 0.047 ∫ 0.056 | Good |
| Steel L | 0.054 | 0.0056 | 0.0060 | 0.050 ∫ 0.061 | 0.052 ∫ 0.059 | Surface Cracking and Slag-patches |

Remarks: D : Ti wire diameter (mm); d: Thickness of Cover metal (mm); v: Feed linear speed (m/min.)

Table 4

| | Mechanical Properties of Products and Surface Defects | | | | | |
|---|---|---|---|---|---|---|
| | Yield Point ($kg/mm^2$) | Tensile Strength ($kg/mm^2$) | Elongation (%) | Plastic Deformation | Yield Point Elongation after 100° C × 60 min. Ageing (%) | Surface Defect (sliver) Occurrence (%) |
| Steel K of Present Invention Composition | 16.8 | 28.9 | 54 | 1.90 | 0 | 0 |
| Steel L | 16.5 | 28.3 | 53 | 1.91 | 0 | 5.8 |

What is claimed is:

1. An addition material for use in continuous casting comprising an addition metal in the form of wire and a cover metal covering said addition metal, said cover being formed of a tape composed of a material consisting of of a low-reactive metal or alloy, having its side portions wrapped around the wire and overlapping each other along the tape's lengthwise direction and tightly covering said addition metal, the amount of overlap corresponding to an angle of not less than 15 degrees at the center of the addition metal wire.

2. The addition material according to claim 1, in which the addition metal is at least one selected from the group consisting of Al, Ti, Zr, B, rare earth elements, V, Nb and their alloys.

3. The addition material according to claim 1, in which the cover metal is in the form of sheet and is one selected from the group consisting of Fe, Cu, Al, Ni, Mo and their alloys.

* * * * *